United States Patent [19]

Sewell et al.

[11] Patent Number: 5,010,216

[45] Date of Patent: Apr. 23, 1991

[54] VELOCITY CHANGE SENSORS

[75] Inventors: Michael R. Sewell; Allan W. DeJong, both of Chatham, Canada

[73] Assignee: Siemens-Bendix Automotive Electronics Limited, Chatham, Canada

[21] Appl. No.: 454,674

[22] Filed: Dec. 21, 1989

[51] Int. Cl.[5] ..... H01H 35/14

[52] U.S. Cl. ..... 200/61.45 M; 200/61.48; 200/61.51; 335/206; 335/205

[58] Field of Search ..... 200/61.45 R, 61.45 M, 200/61.48, 61.49, 61.51; 335/205, 206

[56] References Cited

U.S. PATENT DOCUMENTS

| | | | |
|---|---|---|---|
| 2,508,961 | 5/1950 | McNerney | 200/61.51 |
| 2,802,204 | 8/1957 | Kennelly et al. | 200/61.45 M |
| 3,725,896 | 4/1973 | Wagner | 200/61.45 M X |
| 3,778,572 | 12/1973 | Matsui et al. | 200/61.45 M |
| 3,840,088 | 10/1974 | Marumo et al. | 200/61.45 M X |
| 3,898,400 | 8/1975 | Takada | 200/61.48 |
| 4,636,603 | 1/1987 | Pliml | 200/61.19 X |
| 4,827,091 | 5/1989 | Behr | 200/61.45 M |
| 4,873,401 | 10/1989 | Ireland | 200/61.45 M |

*Primary Examiner*—J. R. Scott

*Attorney, Agent, or Firm*—George L. Boller; Russel C. Wells

[57] ABSTRACT

Various embodiments of sensors are disclosed which contain an inertial mass that is magnetically biased to an initial position. In response to a certain deceleration, the mass is caused to swing about an axis and operate a switch. In some embodiments, the switch is one that is held open by the inertial mass' presence in its initial position and closes when the inertial mass swings away from its initial position, while in other embodiments it is one whose contacts are bridged by a conductive portion of the inertial mass only after the inertial mass has been displaced from its initial position, while in still other embodiments it is a reed switch that is magnetically operated. Motion of the inertial mass can be undampened or dampened. If dampening is desired, it can be accomplished either pneumatically or electromagnetically.

33 Claims, 4 Drawing Sheets

VELOCITY CHANGE SENSORS

BACKGROUND AND SUMMARY OF THE INVENTION

This invention relates to velocity change sensors.

Supplemental inflatable restraint devices that are used in automobiles are activated by velocity change sensors, sometimes called inertia switches. These sensors sense predetermined deceleration characteristics and provide switch closure signals to the devices when such predetermined characteristics are sensed. The predetermined deceleration characteristic that creates switch closure is a function of both the magnitude of deceleration and its duration. The ability of a sensor to sense a predetermined deceleration characteristic is determined by the sensor design. In order to embody this design in production switches, manufacturing tolerances must be closely controlled.

One known type of velocity change sensor that is used with supplemental inflatable restraint devices comprises a sphere that travels within a tube. The predetermined deceleration characteristic that will activate the switch is a function of several parameters. One of these parameters is the closeness of the fit of the sphere within the tube. Controlling the accuracy of this fit in production switches is a significant portion of the switch cost.

The present invention relates to a velocity change sensor which does not utilize the tube and sphere construction and for that reason offers the potential for reducing costs associated with the production of velocity change sensors for supplemental inflatable restraints while still attaining a specified degree of accuracy in such sensors.

Rather than executing linear displacement of a sphere within a tube, a sensor of the present invention comprises a sensing mass that is mounted for swinging motion in response to certain velocity changes. Several embodiments of the invention are disclosed, and they present various means for imparting dampening to the sensor operation for the purpose of discriminating between those velocity changes that should produce switch actuation and those that should not.

The features, advantages, and benefits of the invention will be seen from the following detailed description which is accompanied by drawings. A preferred embodiment according to the best mode presently contemplated for carrying out the invention is disclosed.

DESCRIPTION OF THE PREFERRED EMBODIMENT

Figure 1:
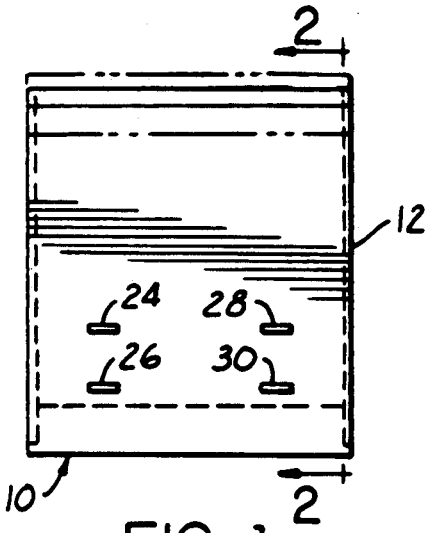
FIG. 1 is a rear elevational view of a first embodiment of sensor.
Figure 2:
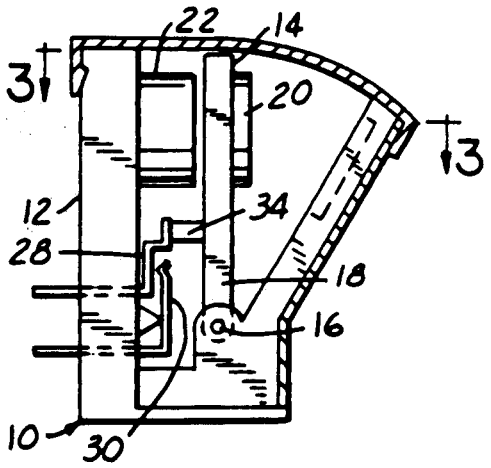
FIG. 2 is a right side elevational view of the sensor's interior as taken in the direction of arrows 2—2 in FIG. 1.
Figure 3:
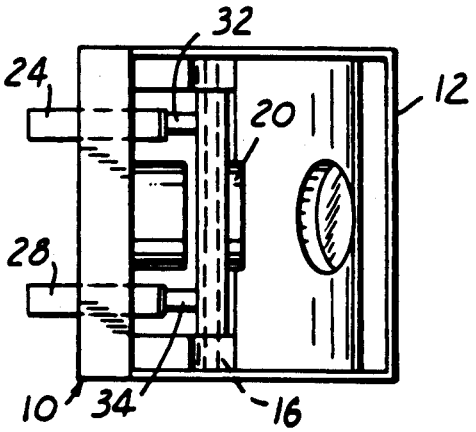
FIG. 3 is a top view of the interior as taken in the direction of arrows 3—3 in FIG. 2.

The first embodiment 10 of FIGS. 1-4 comprises a body 12 that forms an enclosure for the sensor mechanism. The mechanism comprises an inertial mass 14 that is supported on the base of body 12 by means of an axle 16 that enables the inertial mass to swing about the axis of the axle from the position shown in FIG. 2 to that of FIG. 4. FIG. 2 is an initial position that the inertial mass occupies under a non-actuated condition. Upon experiencing a certain velocity change, the inertial mass swings clockwise from the initial position of FIG. 2 to the FIG. 4 position.

Inertial mass 14 comprises a generally rectangular-shaped door 18 that is not ferromagnetic and a ferromagnetic element 20 that is joined in any suitable manner to one face of door 18 in spaced relation to axle 16. The opposite face of the door confronts a permanent magnet 22 that is disposed on body 12 so as to be in general alignment with element 20 when the inertial mass occupies the position of FIG. 2. Magnet 22 has sufficient strength to attract element 20 such that the inertial mass 14 is biased in the counterclockwise direction toward the FIG. 2 position. This bias is overcome only when the sensor undergoes a velocity change of a sufficient character to cause the inertial mass to swing clockwise.

The sensor further comprises two electrical switches that are laterally spaced apart on the lower portion of the rear wall of body 12. One switch comprises two electrically conductive terminals 24, 26 while the other comprises two terminals 28, 30. Each terminal has an interior portion within body 12 and an exterior portion on the outside of body 12. The exterior portions provide for connection of a mating connector, or connectors, via which the sensor is placed in circuit with the supplemental inflatable restraint electrical circuitry (not illustrated). The interior portions of the terminals form switch contacts that are under the control of inertial mass 14.

Figure 4:
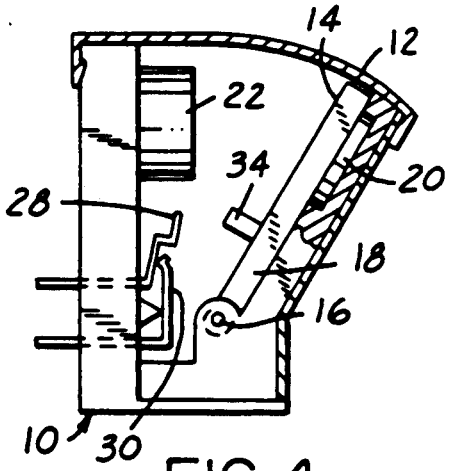
FIG. 4 is right side elevational view of the interior, but illustrating a condition different from that of FIG. 2.

The shapes of terminals 28, 30 can be seen in FIGS. 2 and 4. In the condition portrayed by FIG. 2, projections 32, 34 on door 18 that point in the counterclockwise direction are forcing the respective terminals 24, 28 to be resiliently flexed out of contact with their corresponding terminals 26, 30 respectively. When the sensor experiences a velocity change that causes inertial mass 14 to swing clockwise away from magnet 22, the interior portions of terminals 24, 28 are released by projections 32, 34. As a consequence, terminal 24 relaxes into electrically conductive engagement with terminal 26, and terminal 28 does the same with respect to terminal 30. One switch closure signal is thereby given between terminals 24 and 26, and another between terminals 28 and 30.

Body 12 is shaped for a close fit with respect to door 14 so that as the door swings, its motion is damped by the effect of gaseous fluid present within the body's interior. This creates pneumatic dampening for both clockwise and counterclockwise motion of the inertial mass. This enables the sensor to effectively "integrate" a velocity change pulse upon actuation, and to experience a soft landing upon resetting. Dampening can be also modified by the placement of apertures through door 18.

The sensor also possesses a mechanical advantage for keeping the two switches open, because the point at which the magnet acts on the inertial mass is spaced more distant from axle 16 than are projections 32, 34. This reduces the force that must be applied by the magnet in order to open the switches, and means that a smaller mass and magnet can be used, thereby reducing size cost, and weight without sacrificing the size of the terminals or the capacity thereof.

Figure 8:
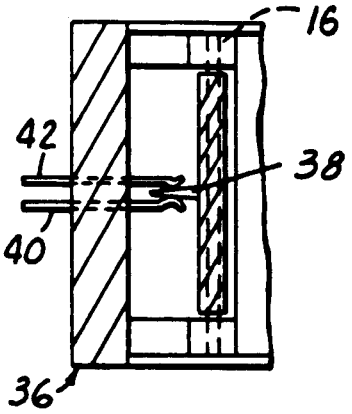
FIG. 8 is a fragmentary sectional view of a third embodiment of sensor as taken in the direction of arrows 8—8 in FIG. 9.
Figure 9:
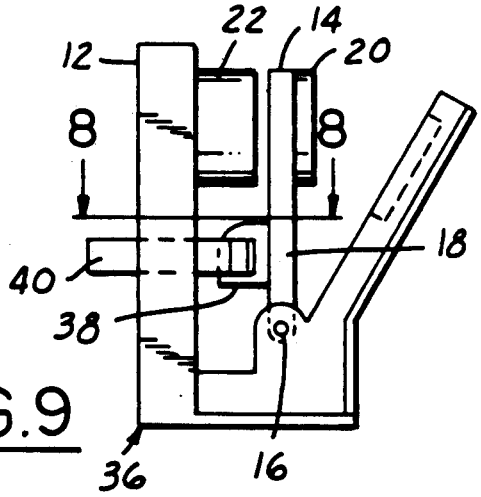
FIG. 9 is a right side elevational view of the interior mechanism.

The embodiment 36 of FIGS. 8 and 9 is quite similar to embodiment 10, and therefore like numbers are used to designate like parts of both embodiments. Embodiment 36 differs principally from embodiment 10 in the details of the switch release. In FIGS. 8 and 9, the door 18 comprises a tapered wedge 38 that serves to separate the interior portions of terminals 40 and 42 when the inertial mass 14 is in its initial position, as shown in FIG. 8. When actuated, the mass swings clockwise, allowing the interior ends of the two terminals to spring into conductive contact with each other thereby causing the sensor to give a switch closure signal.

Figure 5:
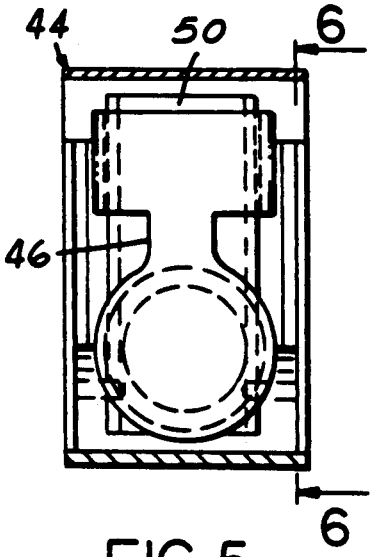
FIG. 5 is a rear elevational view of the interior of a second embodiment of sensor as taken in the direction of arrows 5—5 in FIG. 6.
Figure 6:
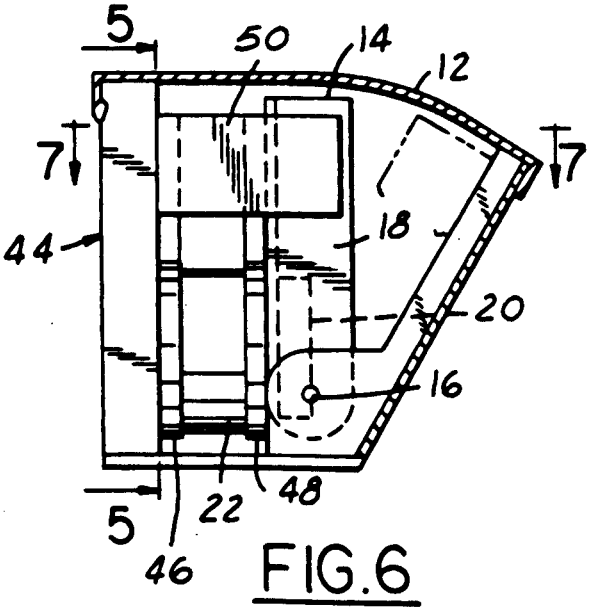
FIG. 6 is a right side elevational view of the sensor's interior as taken in the direction of arrows 6—6 in FIG. 5.
Figure 7:
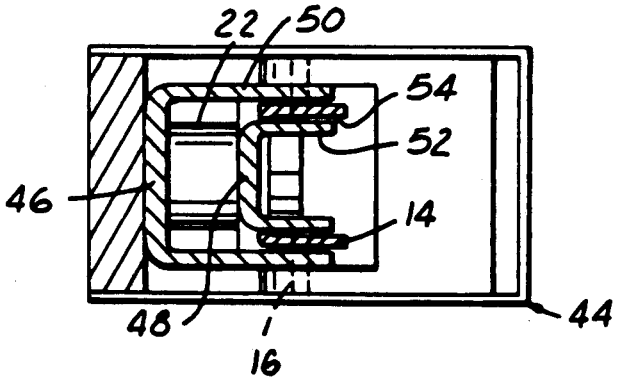
FIG. 7 is a top view of the interior as taken in the direction of arrows 7—7 in FIG. 6.

The embodiment 44 of FIGS. 5, 6, and 7 attains dampening in a different way. It embodies the electromagnetic (eddy current) damping principle that is disclosed in the commonly assigned U.S. Patent of John A. Ireland, U.S. Pat. No. 4,873,401 dated Oct. 10, 1989. To the extent that there are similar constructional features in the embodiment 44 to those previously described for the other embodiment, they are designated by like reference numbers and will not be described in detail.

The ferromagnetic element 20 and magnet 22 are relocated in embodiment 44 so as to be closer to axle 16. Both however continue to be in substantial alignment so that the magnet can bias the inertial mass to the initial position shown in the drawings. Associated with magnet 44 are two ferromagnetic pole pieces 46, 48, one for each pole. Each pole piece comprises a circular keeper portion that is disposed against a corresponding end of magnet 22. An upright extends radially from each circular keeper portion and terminates in U-shaped portion 50, 52 respectively. The smaller U-shaped portion 52 nests within the larger U-shaped portion 50 to define a U-shaped air gap. Door 18 is made of an electrically conductive, non-magnetic material such as aluminum and comprises a rectangular hole 54. The two arms of U-shaped portion 52 are disposed within hole 54 while the two arms of U-shaped portion 50 are disposed laterally outboard of the sides of door 18.

When the sensor is subjected to a velocity change that overcomes the magnetic bias on the inertial mass, the mass swings and in the process, those portions of the door that are disposed in the air gap between the arms of the pole pieces, cut across lines of magnetic flux in the air gap, causing eddy currents to be induced in the door. This creates dampening. Although the drawing does not show them, the terminals constituting the switch portion of the sensor can be arranged in the manner of either preceding embodiment. Alternatively, they could be disposed at the front of the switch body in the path of travel of the inertial mass to be closed when the sensor detects a certain velocity change. If appropriate, the inertial mass could have a cam surface for closing the switch contacts.

Figure 10:
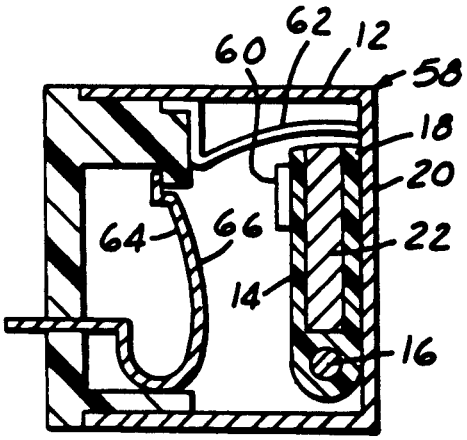
FIG. 10 is a cross-sectional elevational view through a fourth embodiment.

The embodiment 58 in FIG. 10 comprises a body 12, an inertial mass 14, an axle 16, a door 18, a ferromagnetic element 20, and a permanent magnet 22. Element 20 is a portion of the wall of body 12 while magnet 22 is embedded in door 18, the door being non-ferromagnetic, plastic by way of example. The initial position to which the inertial mass 14 is biased is shown by FIG. 10 where the embedded magnet is attracted against the body wall. The inertial mass is adapted to swing in the counterclockwise direction in FIG. 10 in response to an appropriate deceleration pulse to cause an electrical conductor piece 60 carried by the inertial mass to bridge a pair of electrical contacts 64 mounted on the plastic wall of body 12. The contacts are bowed to present convex faces 66 to conductor piece 60. Dampening of the swing is performed by generating eddy current in an arcuately shaped electrically conductive piece 62 that is juxtaposed to the radially outer end of the inertial mass so as to be acted upon by the magnetic flux of magnet 22 as the magnet sweeps over the piece 62 at a generally uniform spacing distance.

Figure 11:
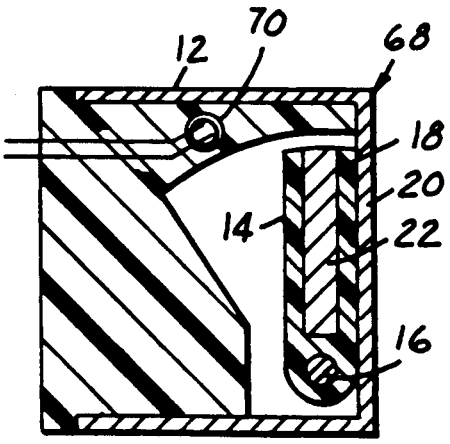
FIG. 11 is a cross-sectional elevational view through a fifth embodiment.

The embodiment 68 of FIG. 11 is similar to embodiment 58 in that the magnet 22 is embedded in the door 18 and the inertial mass 14 is biased against the ferromagnetic portion 20 of the body 12. It differs in that it uses gaseous-fluid dampening to damp the inertial mass motion and has a reed switch 70 that provides the switch signal. Reed switch 70 is a normally open circuit device that closes when the radially outer end of the inertial mass sweeps past it due to the action of magnet 22.

Figure 12:
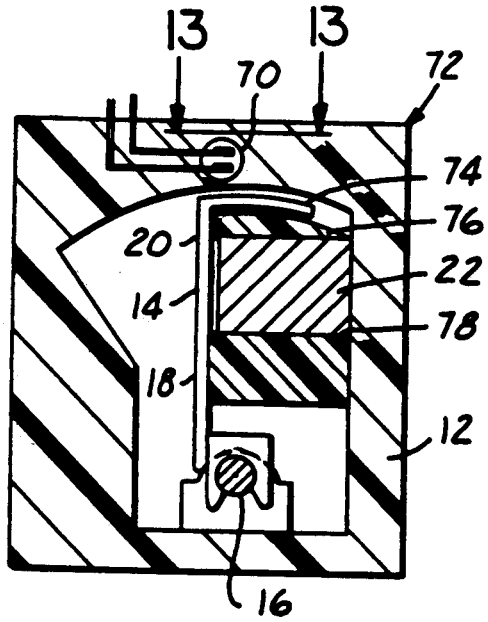
FIG. 12 is a cross-sectional elevational view through a sixth embodiment.
Figure 13:
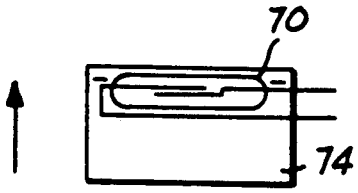
FIG. 13 is a view taken in the direction of arrows 13—13 in FIG. 12.

The embodiment 72 of FIGS. 12 and 13 comprises the parts 12, 14, 16, 18, 20, and 22. The parts 14, 18, and 20 are embodied in a ferromagnetic piece that is biased by magnet 22 to the position illustrated, magnet 22 being embedded in a hole 78 in a plastic member 76 that is mounted on the interior wall surface of body 12. Member 76 is preferably shaped so that the ferromagnetic piece does not touch the magnet end. This embodiment is designed for gaseous fluid dampening in both directions of swinging motion. Like embodiment 68, embodiment 70 uses a reed switch to provide the switch signal. The ferromagnetic piece is shaped to include a shutter 74 which in the position illustrated in FIG. 12 shades the reed switch from the influence of magnet 22. However, upon a certain amount of displacement of the inertial mass in the counterclockwise sense of FIG. 12, the shutter unshades the reed switch at which time the reed switch closes to provide a switch signal.

Figure 14:
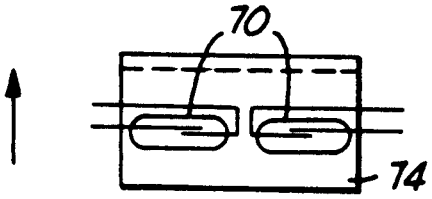
FIG. 14 is a view similar to FIG. 13 illustrating a modification.
Figure 15:
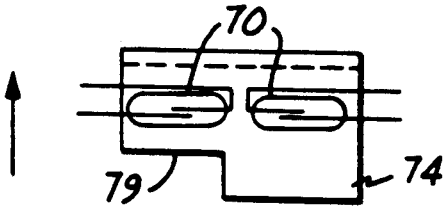
FIG. 15 is a view similar to FIG. 13 illustrating a modification.

FIGS. 14 and 15 portray modified forms utilizing two reed switches 70. The arrangement of FIG. 14 has the two reed switches coaxially aligned so that each one will close essentially contemporaneously with the other. The arrangement of FIG. 15 has the two reed switches also coaxially aligned with each other in the direction of inertial mass motion. However, the shutter 74 includes a notch 79 that is associated with only one of the two reed switches. With this arrangement, the left-hand reed switch as viewed in FIG. 15 will close ahead of the other when the inertial mass is displaced in the counterclockwise sense as viewed in FIG. 12.

Figure 16:
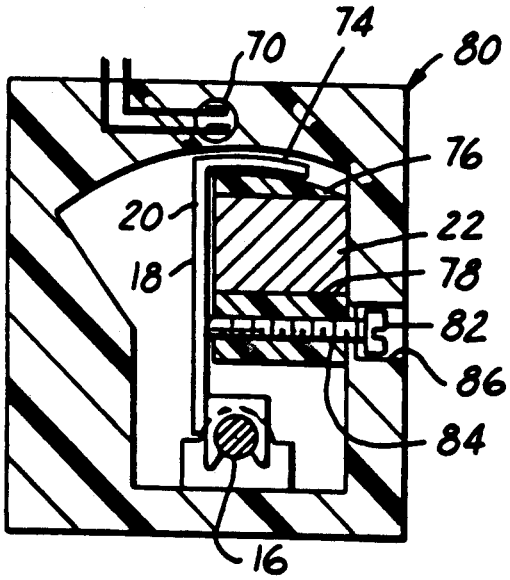
FIG. 16 is a view similar to FIG. 12 illustrating a modification.

The embodiment 80 of FIG. 16 is like that of FIG. 12 except that it has an adjustment mechanism for setting the initial position to which the inertial mass is biased. The adjustment mechanism comprises a screw 82 that is threaded into a hole 84 in member 76 below magnet 22. A counterbore 86 for the screw's head is provided in the wall of body 12. The tip end of the screw abuts inertial mass 14. The extent to which the tip of the screw projects from the interior end of hole 84 determines how far the inertial mass can be displaced in the clockwise sense of FIG. 16, and hence determines the initial bias position for the inertial mass. This adjustment is especially convenient since it can be easily performed and from the outside of the body. Once the desired adjustment has been made, epoxy, not shown, can be introduced into the hole 86 to harden and thereby both to lock the screw in place and to seal the hole so that it does not provide an undesired escape path for gas from the interior of the sensor. It is preferred that the head of the screw be non-circular.

Figure 17:
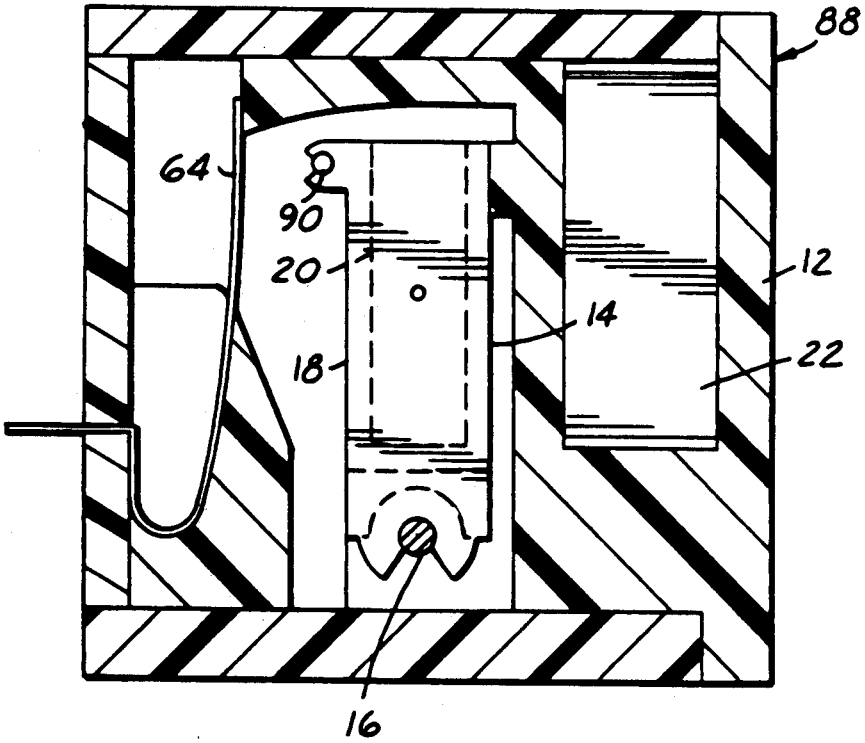
FIG. 17 is a cross-sectional elevational view illustrating another embodiment.
Figure 18:
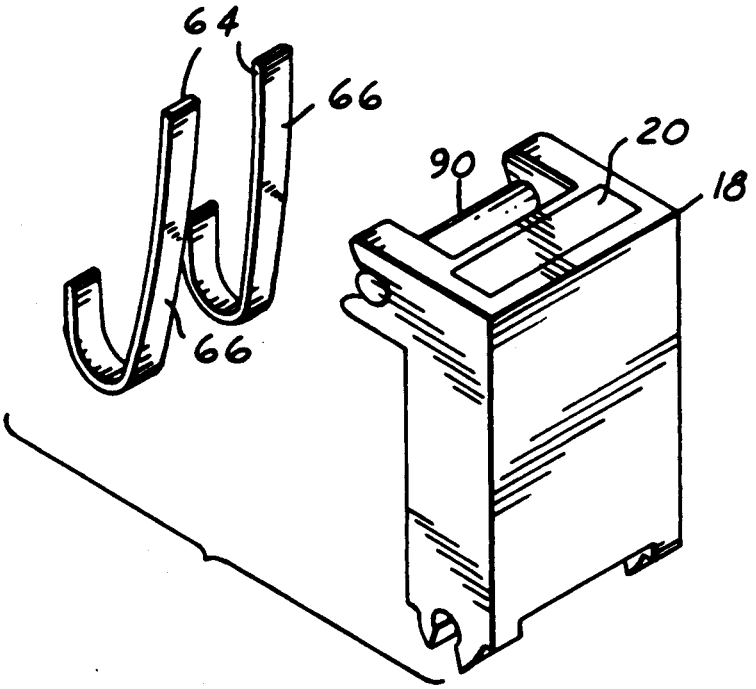
FIG. 18 is an exploded perspective view illustrating a portion of the FIG. 17 embodiment.

In the embodiment 88 of FIGS. 17 and 18, those parts that correspond to similar parts in the embodiments previously described are designated by like reference numerals. Magnet 22 is mounted in the wall of body 12. Ferromagnetic member 20 is contained in the inertial mass 14. The non-ferromagnetic portion of the inertial mass carries a shorting bar 90 that is adapted to bridge the convex surfaces 66 of contacts 64 when the sensor experiences a particular deceleration causing the inertial mass to swing in the counterclockwise direction of FIG. 17.

In all embodiments, the magnet has sufficient strength to return the inertial mass to the initial position after the velocity change that displaced the mass from the initial position ceases. Thus, only when a velocity change has sufficient amplitude and duration will the sensor give a switch signal.

The disclosed sensors have particular value as arming, or safing, sensors for supplemental inflatable restraint systems, and are adaptable to mounting on circuit boards, as in an electronic module.

The sensors are also orientation sensitive, and this means that the orientation can be set to change the delay time and/or sensitivity. For example, the inertial mass can be positioned in its initial position so that gravity may or may not be an influence. In any application of course, testing is important in determining an appropriate orientation.

While a preferred embodiment of the invention has been disclosed and described, it should be understood that principles are applicable to other embodiments.

What is claimed is:

1. A velocity change sensor comprising a body, a mass mounted on said body for swinging motion about an axis that lies transverse to the direction in which velocity change is sensed by the sensor, means on said body and said mass, including a permanent magnet, forming a magnetic circuit for biasing said mass about said axis to an initial position from which said mass swings in response to certain velocity changes applied to the sensor, electrical switch means comprising a pair of electrical contacts mounted on said body at least one of which said pair is resiliently held in non-conducting relationship with the other of said pair coincident with occupancy of said initial position by said mass and which assumes a conducting relationship with said other of said pair only after said mass has swung a predetermined arcuate distance from said initial position.

2. A velocity change sensor as set forth in claim 1 wherein said mass comprises a tapered wedge that fits between both said contacts to keep them separated from each other when said mass occupies said initial position.

3. A velocity change sensor as set forth in claim 1 wherein said mass comprises a projection that points in the direction away from the direction in which said mass swings away from said initial position in response to certain velocity changes applied to the sensor and that engages one of said contacts to hold same in non-conducting relationship with said other while said mass occupies said initial position.

4. A velocity change sensor as set forth in claim 1 wherein said magnet is stationarily mounted on said body.

5. A velocity change sensor as set forth in claim 1 wherein said body comprises an enclosure that closely surrounds said mass and contains a gaseous damping fluid so as to impart gaseous fluid dampening to said mass during at least a portion of the swing of said mass.

6. A velocity change sensor as set forth in claim 5 wherein said mass comprises a flat door.

7. A velocity change sensor as set forth in claim 1 wherein said mass comprises a non-magnetic, electrical conductor in which eddy current is generated by interaction thereof with the magnetic field of said permanent magnet as said mass swings from said initial position to thereby dampen the swing of said mass by electromagnetic dampening.

8. A velocity change sensor as set forth in claim 1 wherein said magnet is arranged to swing in unison with said mass and is disposed radially of said axis further than are said pair of contacts so as to thereby provide a mechanical advantage relative to said pair of contacts during the swing of said mass and said magnet.

9. A velocity change sensor comprising a body, a mass mounted on said body for swinging motion about an axis that lies transverse to the direction in which velocity change is sensed by the sensor, means on said body and said mass, including a permanent magnet, forming a magnetic circuit for biasing said mass about said axis to an initial position from which said mass swings in response to certain velocity changes applied to the sensor, electrical switch means comprising a pair of electrical contacts on said body which are operated by said mass in response to a predetermined velocity change detected by said sensor, wherein said body comprises an enclosure that closely surrounds said mass and contains a gaseous damping fluid so as to impart gaseous fluid dampening to said mass during at least a portion of the swing of said mass.

10. A velocity change sensor as set forth in claim 9 wherein said mass comprises a flat door.

11. A velocity change sensor as set forth in claim 9 wherein said pair of contacts are disposed in non-conducting relationship with each other coincident with occupancy of said initial position by said mass and operate to assume a conducting relationship with each only after said mass has swung a predetermined arcuate distance from said initial position.

12. A velocity change sensor as set forth in claim 11 wherein said pair of contacts are disposed in the path of travel of said mass so as to be operated to conducting relationship with each other only after said mass has swung said predetermined arcuate distance away from said initial position.

13. A velocity change sensor as set forth in claim 12 wherein said pair of contacts are each bowed so as to present convex faces toward said mass, and said mass includes a transverse bar that is electrically conductive and bridges said pair of contacts by striking their convex faces when said sensor has experienced said predetermined velocity change.

14. A velocity change sensor as set forth in claim 11 wherein said pair of contacts are disposed such that said mass travels away from said pair of contacts as it swings away from said initial position.

15. A velocity change sensor as set forth in claim 9 wherein said magnet is mounted on said mass, said body comprises a ferromagnetic wall, and said initial position is defined by the magnetic attraction of said magnet to said ferromagnetic wall.

16. A velocity change sensor as set forth in claim 15 wherein said mass comprises a non-ferromagnetic portion that is disposed between said magnet and said ferromagnetic wall when said mass occupies said initial position.

17. A velocity change sensor comprising a body, a mass mounted on said body for swinging motion about an axis that lies transverse to the direction in which velocity change is sensed by the sensor, means on said body and said mass, including a permanent magnet, forming a magnetic circuit for biasing said mass about said axis to an initial position from which said mass swings in response to certain velocity changes applied to the sensor, electrical switch means comprising a pair of electrical contacts on said body which are disposed in non-conducting relationship with each other coincident with occupancy of said initial position by said mass and which operate to assume a conducting relationship with each other upon said mass swinging from said initial position, wherein said mass comprises a non-magnetic, electrical conductor in which eddy current is generated by interaction thereof with the magnetic field of said permanent magnet as said mass swings from said initial position to thereby dampen the swing of said mass by electromagnetic dampening.

18. A velocity change sensor as set forth in claim 17 wherein said pair of contacts are disposed in the path of travel of said mass so as to be operated to conducting relationship with each other only after said mass has swung said predetermined arcuate distance away from said initial position.

19. A velocity change sensor as set forth in claim 18 wherein said pair of contacts are bowed so as to present convex faces toward said mass, and said mass includes a transverse bar that is electrically conductive and bridges said pair of contacts by striking their convex faces when said sensor has experienced said predetermined velocity change.

20. A velocity change sensor as set forth in claim 17 wherein said pair of contacts are disposed such that said mass travels away from said pair of contacts as it swings away from said initial position.

21. A velocity change sensor as set forth in claim 17 wherein said permanent magnet is stationarily mounted on said body, a pair of pole pieces are associated with the poles of said magnet and are constructed and arranged to define a gap between themselves, a portion of said non-magnetic electrical conductor of said mass being disposed in said gap and traveling within said gap as said mass swings from said initial position.

22. A velocity change sensor as set forth in claim 21 wherein one of said pole pieces comprises a pair of parallel arms that point in the direction in which said mass swings away from said initial position, the other of said pole pieces comprises a pair of parallel arms that are spaced laterally of said first-mentioned pair of arms, one portion of said gap being defined between one of said first-mentioned pair of arms and an adjacent arm of said other pole piece, another portion of said gap being defined between the other of said first-mentioned pair of arms and the other arm of said other pole piece, said non-magnetic electrical conductor having respective portions that respectively are disposed within respective ones of said gap portions.

23. A velocity change sensor as set forth in claim 22 wherein said respective portions of said non-magnetic electrical conductor bound a hole formed in said non-magnetic electrical conductor.

24. A velocity change sensor as set forth in claim 17 wherein said magnet is arranged to swing in unison with said mass and is disposed radially of said axis further than are said pair of contacts so as to thereby provide a mechanical advantage relative to said pair of contacts during the swing of said mass and said magnet.

25. A velocity change sensor comprising a body, a mass mounted on said body for swinging motion about an axis that lies transverse to the direction in which velocity change is sensed by the sensor, means on said body and said mass, including a permanent magnet, forming a magnetic circuit for biasing said mass about said axis to an initial position from which said mass swings in response to certain velocity changes applied to the sensor, reed switch means mounted on said body and is operated in response to a predetermined arcuate displacement of said mass from said initial position, said mass comprising a shutter that is interactive with said magnet and said reed switch means for causing operation of said reed switch means.

26. A velocity change sensor as set forth in claim 25 in which operation of said reed switch means by said shutter is caused by the shutter unshading said reed switch means from said magnet.

27. A velocity change sensor as set forth in claim 26 in which said reed switch means comprises plural reed switches that are sequentially operated by said shutter.

28. A velocity change sensor as set forth in claim 27 in which said reed switches are coaxially aligned, and the sequential operation thereof by said shutter is accomplished by a notch forming an offset in said shutter.

29. A velocity change sensor comprising a body, a mass mounted on said body for swinging motion about an axis that lies transverse to the direction in which velocity change is sensed by the sensor, means on said body and said mass, including a permanent magnet, forming a magnetic circuit for biasing said mass about said axis to an initial position from which said mass swings in response to certain velocity changes applied to the sensor, switch means mounted on said body and is operated in response to a predetermined arcuate displacement of said mass from said initial position, said body having a ferromagnetic wall, and said magnet being on said mass and attracted to said wall to establish said initial position, wherein said mass is non-ferromagnetic and said magnet is embedded therein.

30. A velocity change sensor as set forth in claim 29 including electromagnetic damping means wherein the motion of said mass away from said initial position is electromagnetically dampened by a curved electrically conductive, non-ferromagnetic member disposed in confronting relation to the arcuate swinging motion of said mass.

31. A velocity change sensor as set forth in claim 29 wherein the motion of said mass away from said initial position is gaseous-fluid dampened by having said mass closely fitting within the confines of said body, the confines of said body containing a gaseous damping fluid.

32. A velocity change sensor as set forth in claim 29 including adjustment means on said body for adjusting the setting of said initial position.

33. A velocity change sensor comprising a body, a mass mounted on said body for swinging motion about an axis that lies transverse to the direction in which velocity change is sensed by the sensor, means on said body and said mass, including a permanent magnet, forming a magnetic circuit for biasing said mass about said axis to an initial position from which said mass swings in response to certain velocity changes applied to the sensor, switch means mounted on said body and is operated by a predetermined arcuate displacement of said mass from said initial position, and means for adjusting the setting of said initial position, wherein said means for adjusting the setting of said initial position comprises an adjustment mechanism on said body that is operable from the exterior of said body, and sealing and locking means disposed on the exterior of said body to seal around the adjustment mechanism and lock it in place once a desired setting has been attained for said initial position.

* * * * *